US010558152B2

(12) United States Patent
Yamanaka

(10) Patent No.: US 10,558,152 B2
(45) Date of Patent: Feb. 11, 2020

(54) FIXING DEVICE AND IMAGE FORMING APPARATUS

(71) Applicant: KYOCERA Document Solutions Inc., Osaka (JP)

(72) Inventor: Tatsuya Yamanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/422,332

(22) Filed: May 24, 2019

(65) Prior Publication Data

US 2019/0369532 A1 Dec. 5, 2019

(30) Foreign Application Priority Data

May 29, 2018 (JP) ..... 2018-102665

(51) Int. Cl.
*G03G 15/20* (2006.01)

(52) U.S. Cl.
CPC ..... *G03G 15/2028* (2013.01)

(58) Field of Classification Search
None
See application file for complete search history.

(56) References Cited

U.S. PATENT DOCUMENTS 7,463,858 B2 12/2008 Shiokawa et al.
2002/0141792 A1* 10/2002 Nakano ..... G03G 15/2028 399/323

FOREIGN PATENT DOCUMENTS

JP 2007-072259 A 3/2007

* cited by examiner

*Primary Examiner* — Roy Y Yi
(74) *Attorney, Agent, or Firm* — Studebaker & Brackett PC

(57) ABSTRACT

A fixing device includes a fixing member, a separating claw, and a moving mechanism. The fixing member heats a toner image on a recording medium while rotating around an axis. The separating claw separates the recording medium from a surface of the fixing member. The moving mechanism reciprocates the separating claw in an axial direction and temporarily stops the separating claw at both ends of a moving range of the separating claw.

8 Claims, 11 Drawing Sheets

FIXING DEVICE AND IMAGE FORMING APPARATUS

INCORPORATION BY REFERENCE

This application is based on and claims the benefit of priority from Japanese Patent application No. 2018-102665 filed on May 29, 2018, the entire contents of which are incorporated herein by reference.

BACKGROUND

The present disclosure relates to a fixing device and an image forming apparatus including this fixing device.

An image forming apparatus of an electrographic manner includes a fixing device fixing a toner image on a recording medium, such as a sheet.

Conventionally, the fixing device includes a separating claw separating a recording medium from a fixing member fixing a toner image on the recording medium, and a separating claw moving mechanism moving the separating claw along a surface of the fixing member. Because the separating claw comes into contact with the surface of the fixing member, the surface of the fixing member contacting with the separating claw is scraped over time. The fixing device works while paying attention to moving speed of the separating claw so that the moving speed V of the separating claw satisfies $1\times10^{-3}$ mm/s≤V≤0.1 mm/s, and thereby, a scraped amount of the surface of the fixing member is restrained.

Because the above-mentioned separating claw of the fixing device reciprocates without stopping both ends of a moving range, contact time of the separating claw with the fixing member becomes long at a center portion of the moving range in comparison with both end portions of the moving range. As a result, there are problems that a portion of the surface of the fixing member corresponding to the center portion of the moving range of the separating claw is convergently scraped and lifetime of the fixing member is shortened.

SUMMARY

In accordance with the present disclosure, a fixing device includes a fixing member, a separating claw, and a moving mechanism. The fixing member heats a toner image on a recording medium while rotating around an axis. The separating claw separates the recording medium from a surface of the fixing member. The moving mechanism reciprocates the separating claw in an axial direction and temporarily stops the separating claw at both ends of a moving range of the separating claw.

In accordance with the present disclosure, an image forming apparatus includes the fixing device as described above.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
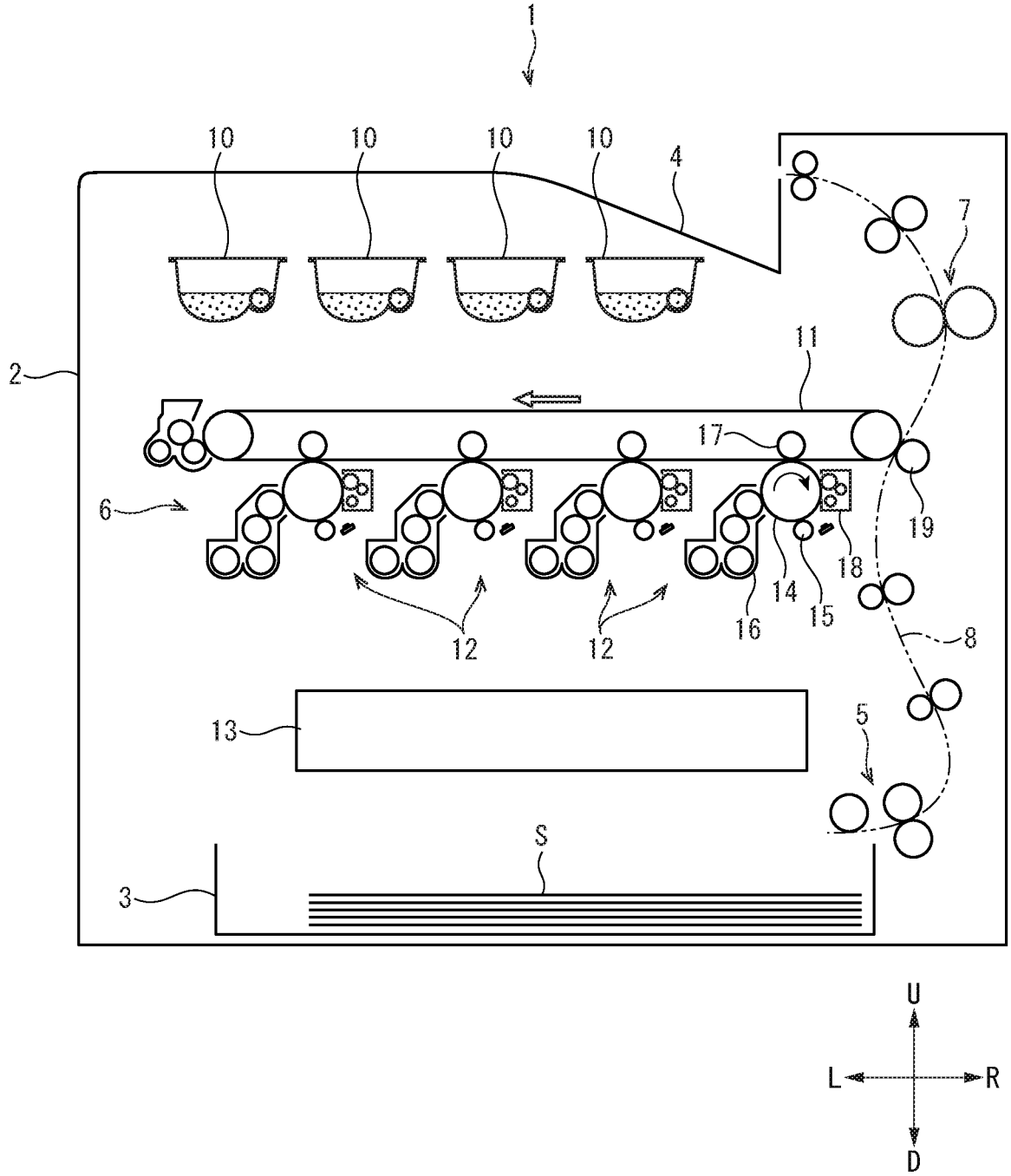
FIG. 1 is a sectional view schematically showing an internal structure of a color printer according to an embodiment of the present disclosure.

Hereinafter, with reference to the accompanying drawings, an embodiment of the present disclosure will be described. Incidentally, in the drawings, a reference character "Fr" indicates a "front" side, a reference character "Rr" indicates a "rear" side, a reference character "L" indicates a "left" side, a reference character "R" indicates a "right" side, a reference character "U" indicates an "upward" side, and a reference character "D" indicates a "downward" side. Moreover, terms "upstream" and "downstream" and other terms similar to these indicate an "upstream" side and a "downstream" side in a conveying direction (a passing direction) of a sheet S and other expressions similar to these.

With reference to FIG. 1, a color printer 1 as an example of an image forming apparatus will be described. FIG. 1 is a sectional view schematically showing an internal structure of the color printer 1 as viewed from a front side.

The color printer 1 includes an apparatus body 2 constituting a roughly rectangular parallelepiped external appearance. At a lower side of the apparatus body 2, a sheet feeding cartridge 3 storing sheets S (recording mediums) made of paper is detachably attached. On an upper face of the apparatus body 2, an ejected sheet tray 4 is provided. Incidentally, the sheet S is not restricted by paper, but may be made of resin or others.

Moreover, the color printer 1 includes a sheet feeding device 5, an imaging device 6 and a fixing device 7 inside the apparatus body 2. The sheet feeding device 5 is provided in an upstream end of a conveying path 8 extended from the sheet feeding cartridge 3 to the ejected sheet tray 4. The fixing device 7 is provided at a downstream side in the conveying path 8 and the imaging device 6 is provided between the sheet feeding device 5 and the fixing device 7 in the conveying path 8.

The imaging device 6 includes four toner containers 10, an intermediate transferring belt 11, four drum units 12 and an optical scanning device 13. In the four toner containers 10, toners (developers) of four colors (yellow, magenta, cyan and black) are contained. Each drum unit 12 includes a photosensitive drum 14, a charging device 15, a development device 16, a primary transferring roller 17 and a cleaning device 18. The primary transferring roller 17 is arranged so as to put the intermediate transferring belt 11 between the photosensitive drum 14 and the primary transferring roller 17. With a right side of the intermediate transferring belt 11, a secondary transferring roller 19 comes into contact to form a transferring nip.

A controlling device (not shown) of the color printer 1 suitably controls each component to execute image forming process as follows. The charging device 15 electrically charges a surface of the photosensitive drum 14. The photosensitive drum 14 receives scanning light emitted from the optical scanning device 13 to carry an electrostatic latent image. The development device 16 develops the electrostatic latent image on the photosensitive drum 14 to a toner image by using the toner supplied from the toner container 10. The primary transferring roller 17 primarily transfers the toner image on the photosensitive drum 14 to the intermediate transferring belt 11 being rotated. The intermediate transferring belt 11 rotates and carries the toner image of full color formed by laminating the toner images of four colors. The sheet S is fed out from the sheet feeding cartridge 3 to the conveying path 8 by the sheet feeding device 5. The secondary transferring roller 19 secondarily transfers the toner image on the intermediate transferring belt 11 to the sheet S passing through the transferring nip. The fixing device 7 thermally fixes the toner image to the sheet S. After that, the sheet S is ejected to the ejected sheet tray 4. The cleaning device 18 removes the toner remained on the photosensitive drum 14.

Figure 2:
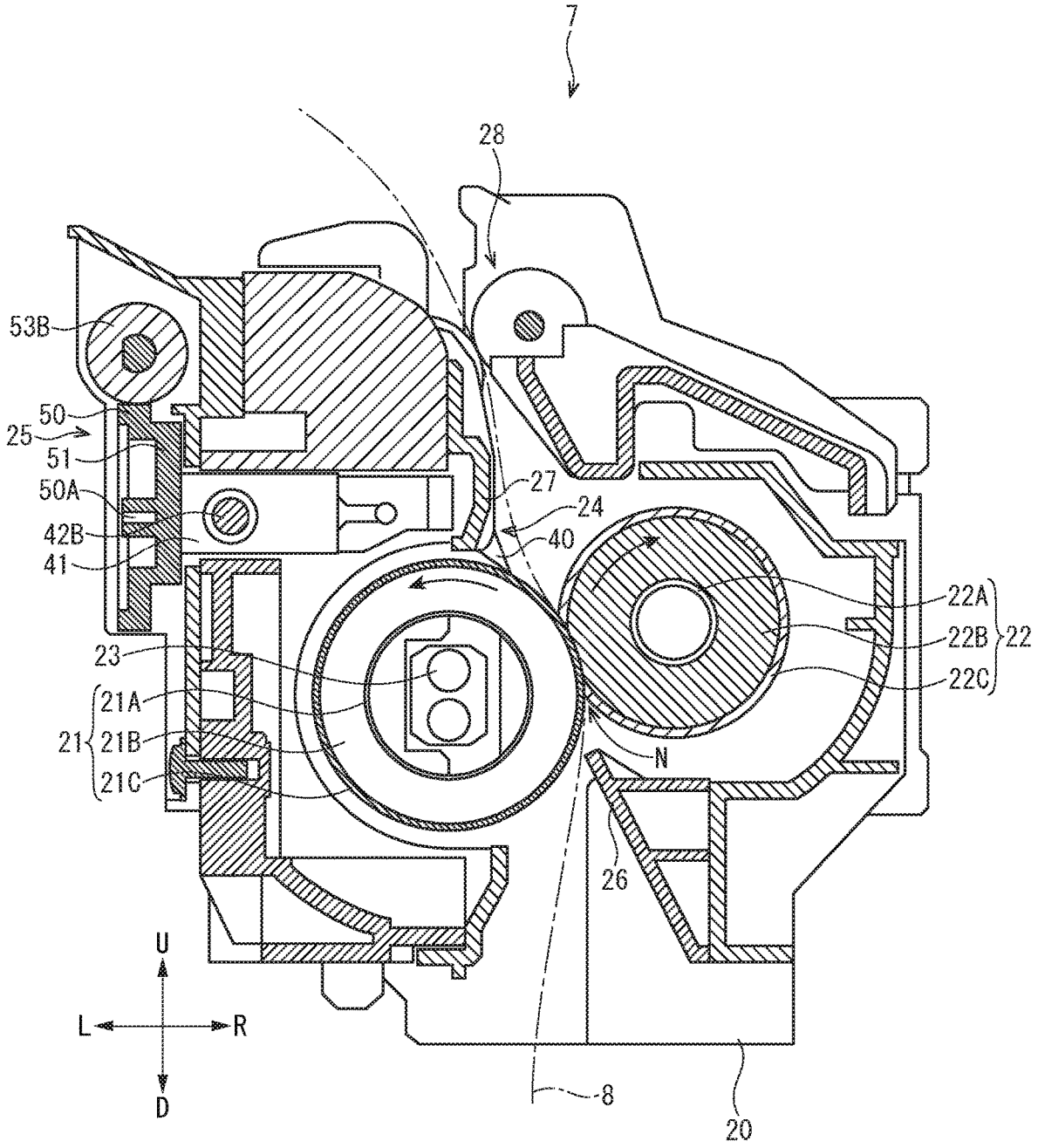
FIG. 2 is a sectional view showing a fixing device according to the embodiment of the present disclosure.
Figure 3:
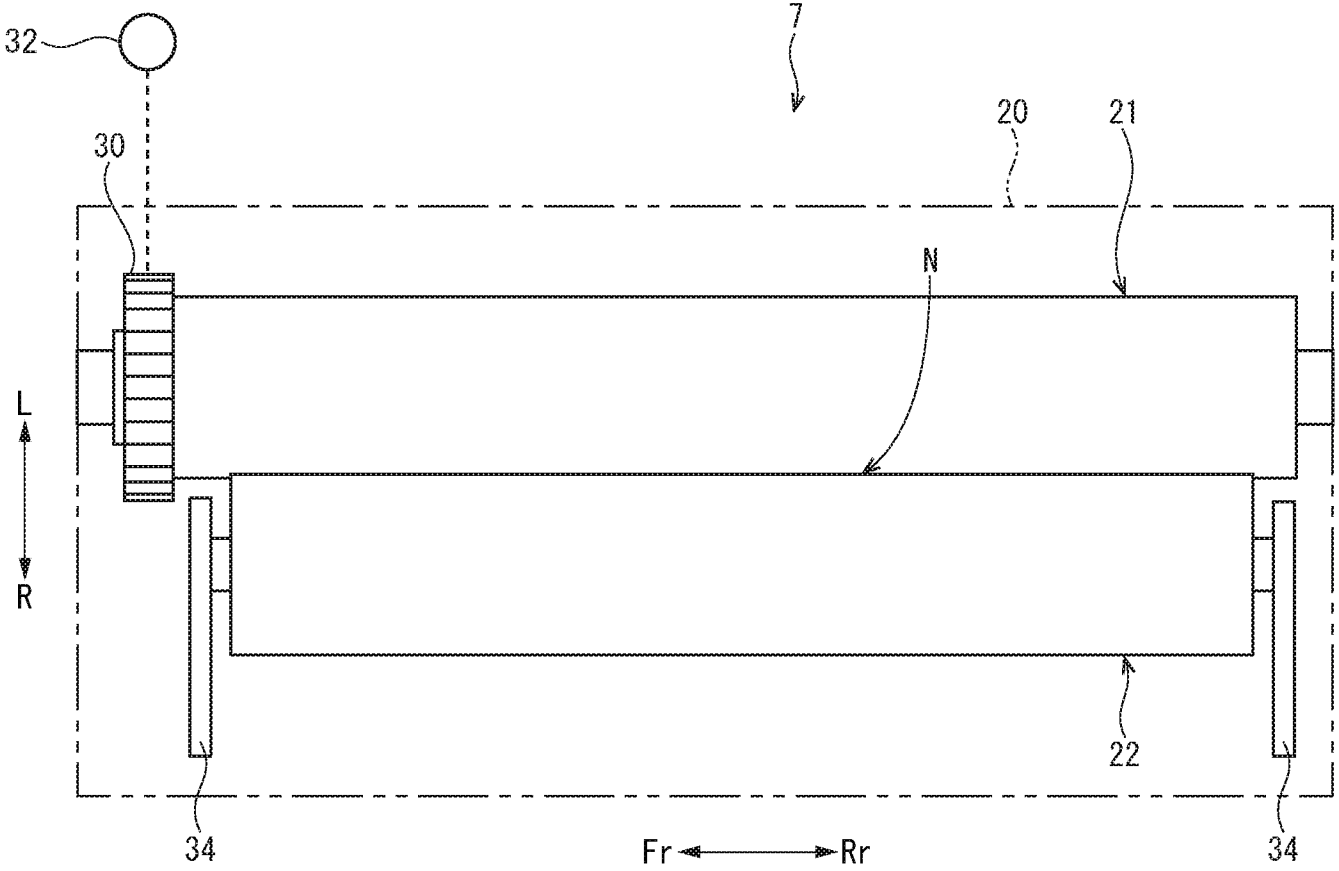
FIG. 3 is a plane view schematically showing the fixing device according to the embodiment of the present disclosure.
Figure 4:
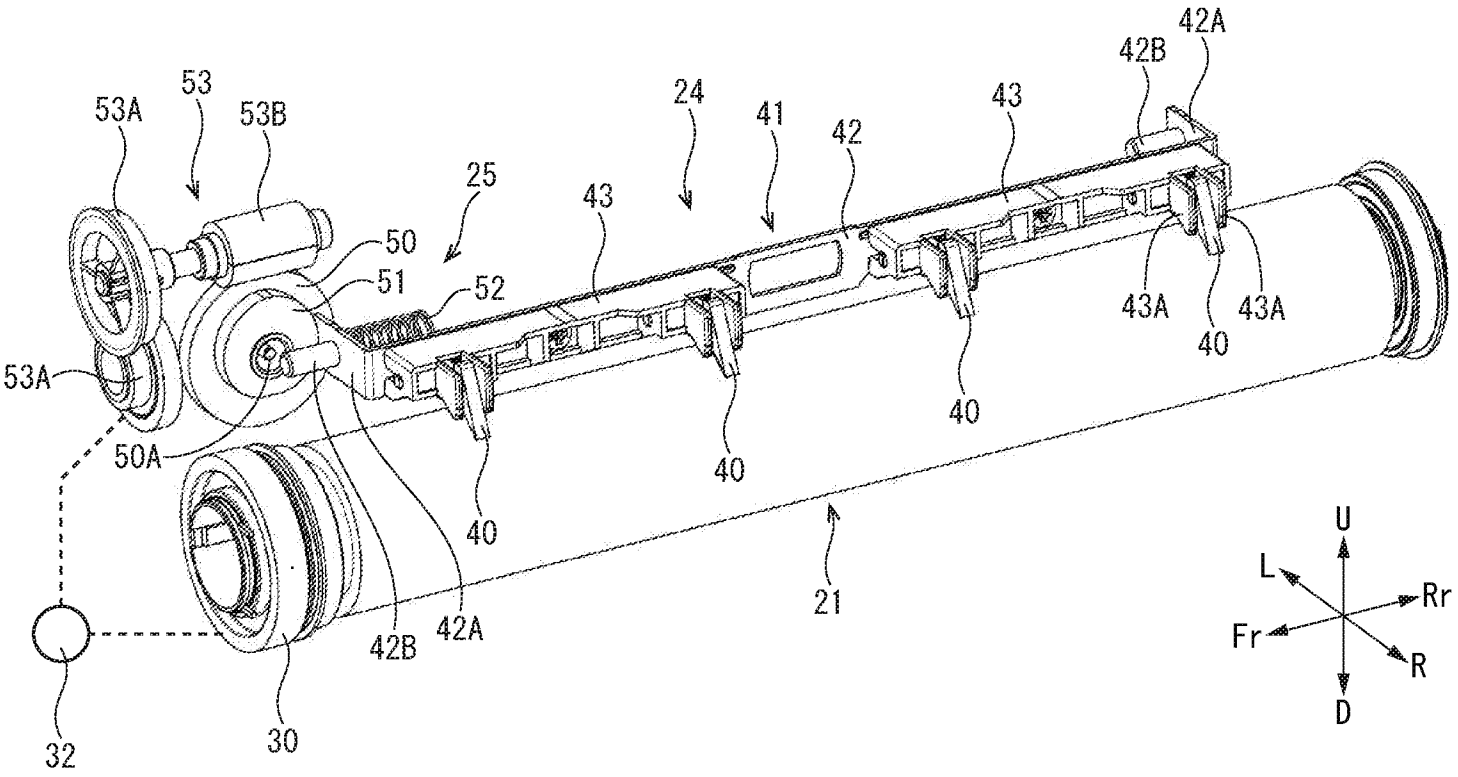
FIG. 4 is a perspective view showing a fixing roller, a separating unit and a moving mechanism in the fixing device according to the embodiment of the present disclosure.
Figure 5:
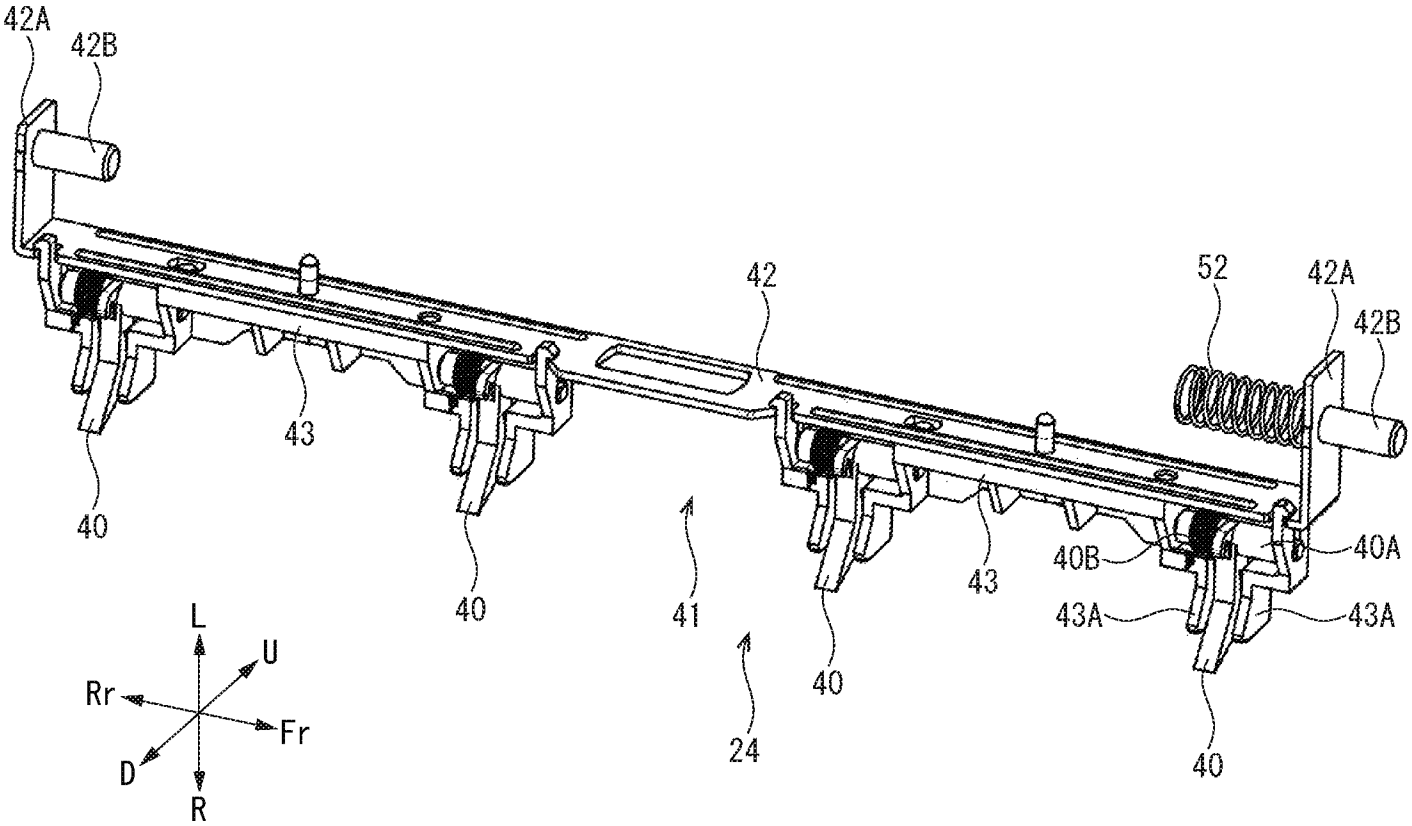
FIG. 5 is a perspective view showing the separating unit and others in the fixing device according to the embodiment of the present disclosure.

Next, with reference to FIGS. 2-5, the fixing device 7 will be described. FIG. 2 is a sectional view showing the fixing device 7. FIG. 3 is a plane view schematically showing the fixing device 7. FIG. 4 is a perspective view showing a fixing roller 21, a separating unit 24 and a moving mechanism 25. FIG. 5 is a perspective view showing the separating unit 24 and others.

As shown in FIGS. 2 and 3, the fixing device 7 includes a casing 20, the fixing roller 21, a pressuring roller 22, a halogen heater 23, the separating unit 24 and a moving mechanism 25 (refer to FIG. 8). The casing 20 is supported by the apparatus body 2. The fixing roller 21 and the pressuring roller 22 are rotatably supported inside the casing 20. The halogen heater 23 is arranged inside the fixing roller 21. The separating unit 24 and the moving mechanism 25 are arranged at a downstream side from a contact portion (a pressuring area N) of the fixing roller 21 and the pressuring roller 22.

The casing 20 is made of a metal plate, heat-resistant resin or the like and formed in a roughly rectangular parallelepiped shape elongated in forward and backward directions. Inside the casing 20, a part of the conveying path 8 through which the sheet S passes is formed. At a lower side in the casing 20, an approach guide 26 guiding the sheet S to the pressuring area N is provided (refer to FIG. 2). At an upper part in the casing 20, a guiding member 27 guiding the sheet S passed through the pressuring area N to a pair of ejecting rollers 28 is provided. The pair of ejecting rollers 28 put the sheet S passed through the pressuring area N between the ejecting rollers 28 and convey the sheet S to a downstream side.

The fixing roller 21 as an example of a fixing member is formed in a roughly cylindrical shape elongated in the forward and backward directions (an axial direction). The fixing roller 21 includes a fixing core metal 21A made of metal, a fixing elastic layer 21B laminated on an outer circumferential face of the fixing core metal 22A, and a fixing belt 21*c* covering the fixing elastic layer 21B. To a front part of the fixing roller 21, a fixing gear 30 is attached (refer to FIG. 3). To the fixing gear 30, a driving motor 32 (of a pinion gear) is connected via a gear train (not shown) composed of a plurality of gears.

The pressuring roller 22 as an example of a pressuring member is formed in a roughly cylindrical shape elongated in the forward and backward directions (the axial direction) and arranged at a right side of the fixing roller 21. The pressuring roller 22 includes a pressuring core metal 22A made of metal, a pressuring elastic layer 22B laminated on an outer circumferential face of the pressuring core metal 22A, and a pressuring release layer 22*c* covering the pressuring elastic layer 22B. Both front and rear ends of the pressuring roller 22 (the pressuring core metal 22A) are rotatably supported by a pair of movable frames 34 (refer to FIG. 3). The movable frames 34 are supported by the casing 20 so as to swing in left and right directions and connected to a pressure adjusting part (not shown) including a spring, an eccentric cam and others.

When the pressure adjusting part turns the movable frames 34 to a side of the fixing roller 21, the pressuring roller 22 is pressured to the fixing roller 21 to form the pressuring area N being in compression pressured between the pressuring roller 22 and the fixing roller 21. On the other hand, when the pressure adjusting part turns the movable frames 34 to a direction separating from the fixing roller 21, pressuring of the pressuring roller 22 to the fixing roller 21 is released to form the pressuring area N being in decompression. Incidentally, the pressuring area N indicates an area within a range from an upstream side position where the pressure is 0 Pa to a downstream side position where the pressure is 0 Pa again via a position where the pressure is a maximum.

As shown in FIG. 2, the halogen heater 23 is formed in a roughly bar shape elongated in the forward and backward directions (the axial direction). The halogen heater 23 includes a halogen lamp emitting light within an infrared region and heating the fixing roller 21. Incidentally, in the embodiment, the halogen heater 23 is applied as a heat source, but a carbon heater or the like may be applied as the heat source instead of the halogen heater 23. Alternatively, an induction heating type heater may be arranged as the heat source outside of the fixing roller 21.

Incidentally, inside the casing 20, a temperature sensor (not shown), such as a thermopile or a thermistor, sensing surface temperature of the fixing roller 21 (or temperature of the halogen heater 23) is provided. To the controlling device of the color printer 1, the driving motor 32, the halogen heater 23, the temperature sensor and others are electrically connected. The controlling device controls the driving motor 32, the halogen heater 23, the temperature sensor and others via various drive circuits.

As shown in FIGS. 2 and 4, the separating unit 24 is arranged above the fixing roller 21. The separating unit 24 includes a plurality of (e.g. four) separating claws 40 and a supporting frame 41. The plurality of separating claws 40 are supported by the supporting frame 41 arranged in parallel to the fixing roller 21. Incidentally, because the plurality of separating claws 40 have the same shape as each other, one separating claw 40 will be described hereinafter.

The separating claw 40 is formed in a roughly thick plate shape having a roughly acute triangle as viewed from the front side. A distal end of separating claw 40 is formed in an acute shape and comes into contact with a surface of the fixing roller 21 at a downstream side from the pressuring area N (refer to FIG. 2).

As shown in FIGS. 4 and 5, the supporting frame 41 includes, for example, a sheet metal member 42 elongated in the forward and backward directions and two box-shaped members 43 fixedly attached to the sheet metal member 42. In a proximal end (a root portion) of the above-described separating claw 40, a rotating shaft 40A extended to both front and rear sides is provided (refer to FIG. 5). The rotating shaft 40A is rotatably supported by any one of the box-shaped members 43. Around the rotating shaft 40A, a torsion coil spring 40B is wound to bias the separating claw 40 toward the fixing roller 21. In the box-shaped member 43, each pair of protecting ribs 41A are formed and arranged at positions adjacent to both front and rear sides of each separating claw 40. Each protecting rib 41A is protruded toward the conveying path 8 inside the casing 20.

Both front and rear ends of the sheet metal member 42 are bent to a left side (an opposite side to the separating claw 40) to constitute a pair of bent pieces 42A. To the bent pieces 42A, roughly columnar supporting pins 42B extended to a front side are fixedly attached. A pair of supporting pins 42B is slidably supported by bearings (not shown) opened in the casing 20. That is, the supporting frame 41 is supported by the casing 20 so as to slide in the forward and backward directions via the pair of supporting pins 42B. Incidentally, the above-described guiding member 27 is located so as to cover the supporting frame 41 (refer to FIG. 2).

Figure 6:
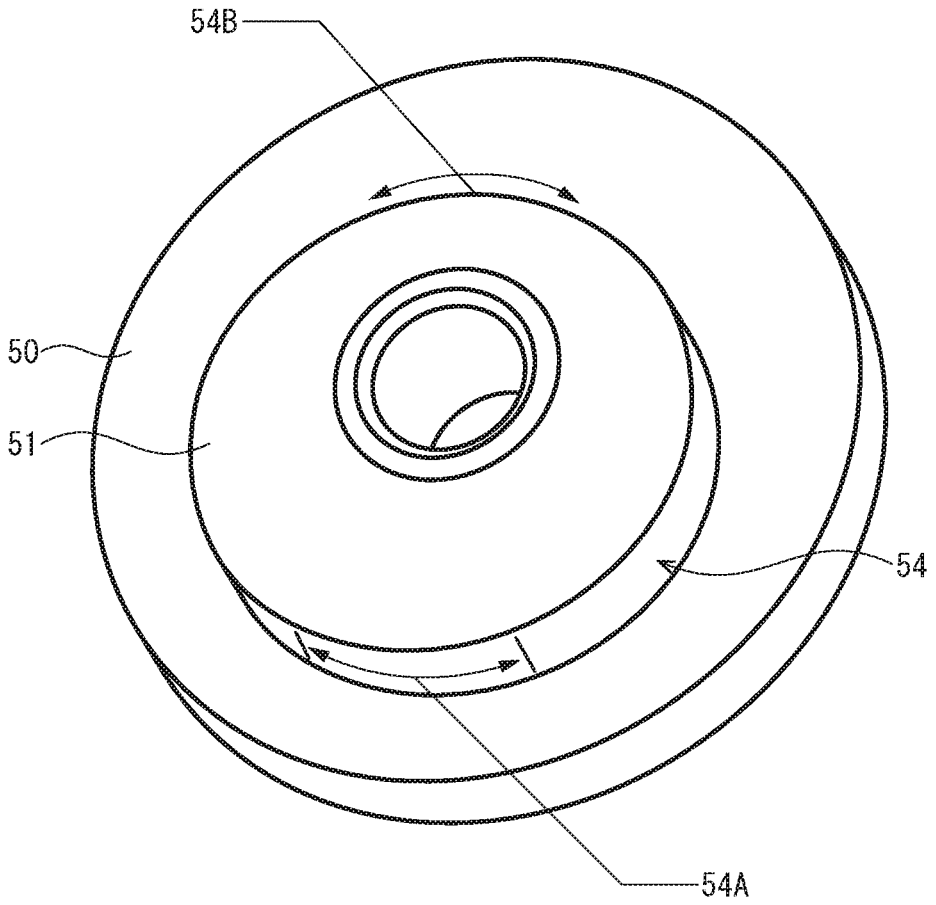
FIG. 6 is a perspective view showing a input gear and an eccentric cam in the fixing device according to the embodiment of the present disclosure.

Next, with reference to FIGS. 4 and 6, the moving mechanism 25 will be described. FIG. 6 is a perspective view showing an input gear 50 and an eccentric cam 51 of the moving mechanism 25.

As shown in FIG. 4, the moving mechanism 25 is located above a front part of the fixing roller 21. The moving mechanism 25 includes the input gear 50, the eccentric cam 51, and a biasing member 52. The moving mechanism 25 has a function reciprocating the separating claw 40 in the axial direction.

As shown in FIGS. 4 and 6, the input gear 50 is a worm wheel having a plurality of teeth on an outer circumferential face of a disk. In an axial center of the input gear 50, a gear shaft part 50A extended in the left and right directions (a orthogonal direction to the fixing roller 21) is formed. The gear shaft part 50A is rotatably supported by the casing 20. The input gear 50 (of the teeth) is connected to the driving motor 32 (of the pinion gear) via a power transmitting mechanism 53. The power transmitting mechanism 53 includes a plurality of disk gear 53A (a spur gear, a stepped gear and others) and a warm gear 53B. A final gear of the power transmitting mechanism 53 is the warm gear 53B, and the warm gear 53B is meshed with the input gear 50.

The eccentric cam 51 is formed in a roughly cylindrical shape and protruded from a right end face of the input gear 50 to a front side. The eccentric cam 51 is located so that a center of the eccentric cam 51 is at a position shifted from the gear shaft part 50A of the input gear 50. That is, the eccentric cam 51 is a so-called disk cam having various distances (eccentric radiuses) from its rotation center (the gear shaft part 50A) to its outer circumferential face. Incidentally, the input gear 50 and the eccentric cam 51 are made of, for example, metal material.

As shown in FIG. 6, the outer circumferential face of the eccentric cam 51 is a cam face 54 having a predetermined profile. The cam face 54 comes into contact with a front face of the bent piece 42A formed at a front side of the supporting frame 41 (refer to FIG. 4). The cam face 54 of the eccentric cam 51 is a continuously curved face including a first cam face 54A within a section of a maximum radius and a second cam face 54B within a section of a minimum radius. The first cam face 54A and the second cam face 54B are formed at positions facing to each other across the rotation center (the gear shaft part 50A). The first cam face 54A and the second cam face 54B are formed so that respective peripheral lengths (sections) become a degree of 11-12% of the whole peripheral length of the cam face 54. Incidentally, parts between the first cam face 54A and the second cam face 54B in the cam face 54 are curved faces with eccentric radiuses continuously increasing and decreasing and are formed symmetrically across the rotation center.

As shown in FIG. 4, the biasing member 52 is a so-called compression coil spring and is installed between a rear face of the bent piece 42A formed in the front side of the supporting frame 41 and the casing 20. The biasing member 52 has a function biasing the separating claws 40 (the separating unit 24) toward the cam face 54 of the eccentric cam 51.

Next, with reference to FIG. 2, an action (fixing process) of the fixing device 7 will be described. Incidentally, in case where the fixing process is executed, the pressuring roller 22 is pressed to the fixing roller 21 by the pressure adjusting part.

First, the controlling device controls driving of the driving motor 32 and the halogen heater 23. The fixing roller 21 is rotated by receiving driving force of the driving motor 32 and the pressuring roller 22 is rotated by following the fixing roller 21 (refer to a fine solid line arrow in FIG. 2). The halogen heater 23 heats the fixing roller 21 from the inside of the fixing roller 21. The temperature sensor transmits a detection signal indicating temperature of the fixing roller 21 (or the halogen heater 23) via an input circuit. The controlling device, when receives the detection signal indicating reaching to setting temperature from the temperature sensor, starts the image forming process described above. The sheet S having the transferred toner image is inserted into the casing 20 and the fixing roller 21 heats the toner (the toner image) on the sheet S passing through the pressuring area N while being rotated around an axis. The pressuring roller 22 pressures the toner on the sheet S passing through the pressuring area N while being rotated around an axis. Then, the toner image if fixed on the sheet S. The plurality of separating claws 40 separate the sheet S passed through the pressuring area N from the surface of the fixing roller 21. Subsequently, the sheet S having the fixed toner image is fed to the outside of the casing 20 and ejected onto the ejected sheet tray 4.

Incidentally, since the fixing roller 21 is rotated while making the separating claws 40 contact with the surface of the fixing roller 21, a portion of the fixing roller 21 continuously coming into contact with the separating claws 40 is worn (scraped). Thereupon, in order to restrain wear of the fixing roller 21, in this fixing device 7, the moving mechanism 25 reciprocatingly moves the separating claws 40 in the axial direction in accordance with rotation of the fixing roller 21.

Figure 7:
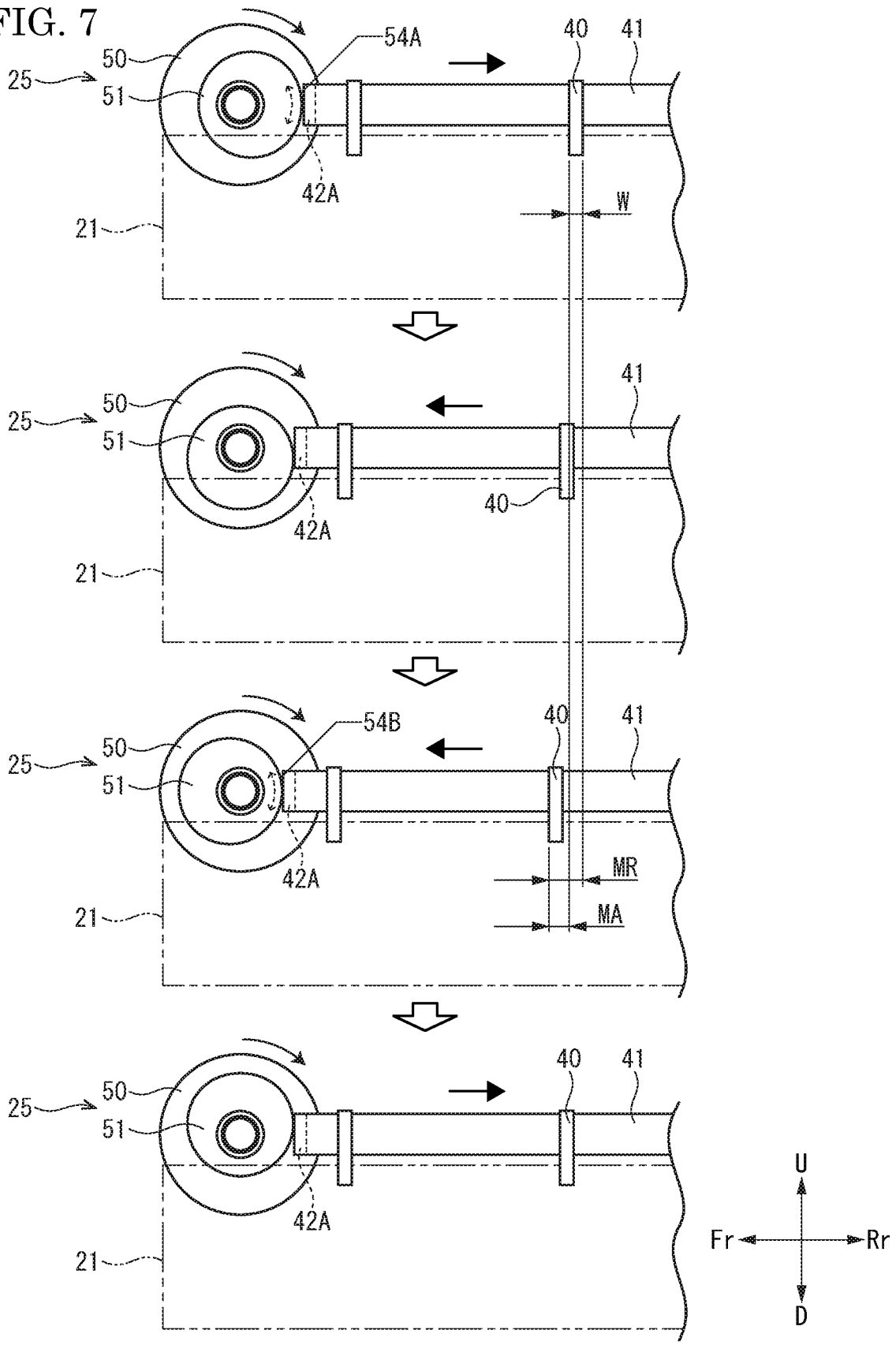
FIG. 7 is a side view showing an action of the moving mechanism in the fixing device according to the embodiment of the present disclosure.
Figure 8A:
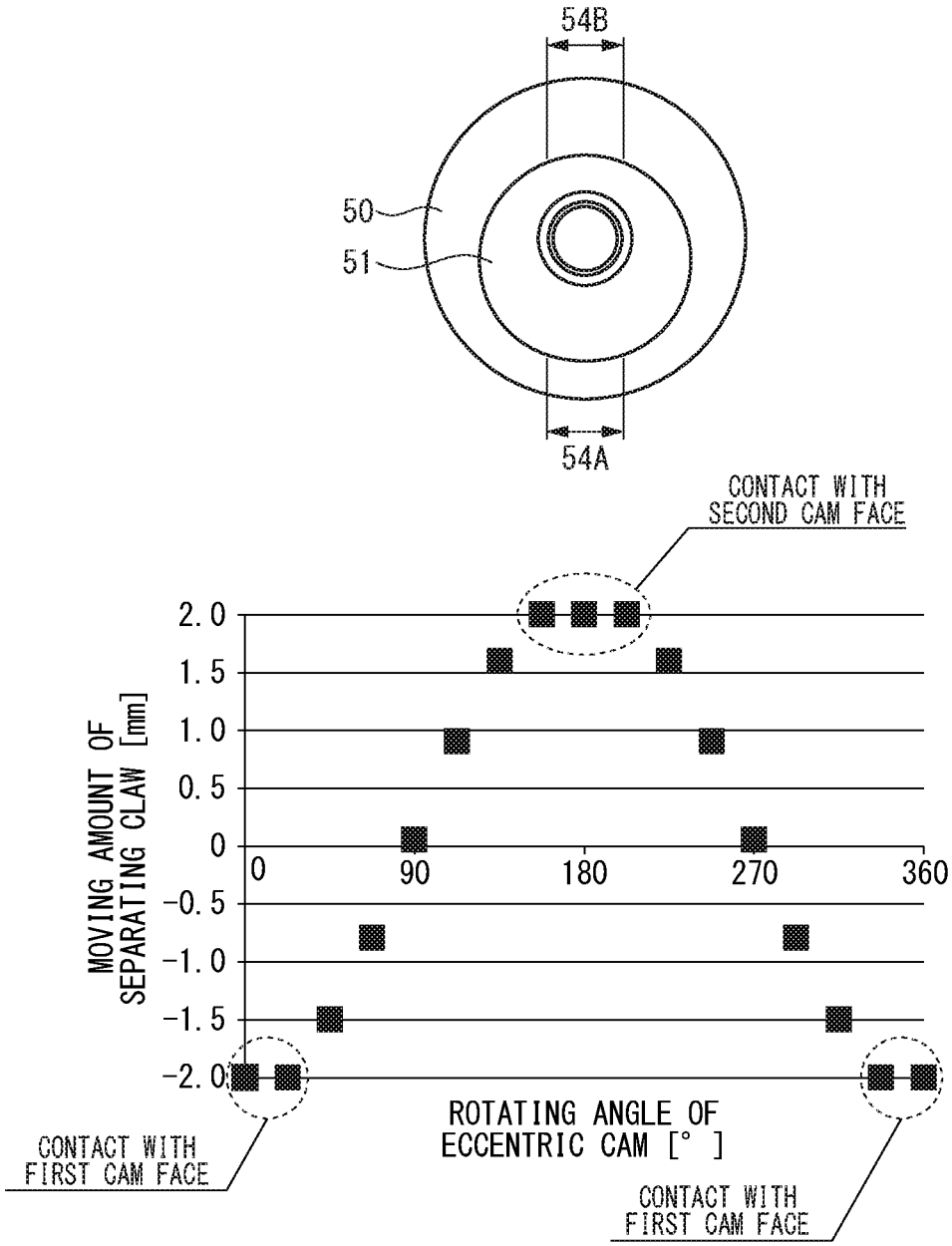
FIG. 8A is a graph plotting relationship of a moving amount of a separating claw and a rotating angle of the eccentric cam in the moving mechanism of the fixing device according to the embodiment of the present disclosure.
Figure 8B:
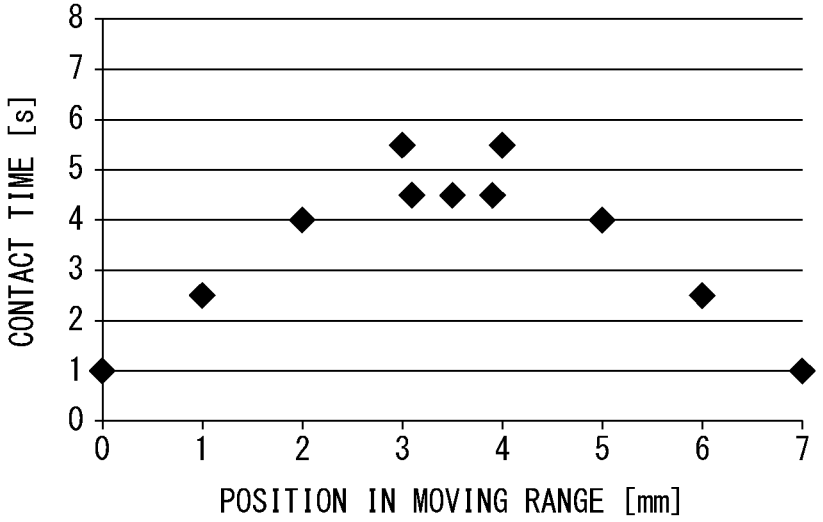
FIG. 8B is a graph plotting contact time of the separating claw within a moving range in the moving mechanism of the fixing device according to the embodiment of the present disclosure.

As shown in FIGS. 7, 8A and 8B, an action of the moving mechanism 25 will be described. FIG. 7 is a side view showing an action of the moving mechanism 25. FIG. 8A is a graph plotting relationship of a moving amount MA of the separating claw 40 and a rotating angle of the eccentric cam 51. FIG. 8B is a graph plotting contact time of the separating claw 40 within a moving range MR.

The driving force of the driving motor 32 rotates the input gear 50 at an approximately constant speed via the power transmitting mechanism 53. The moving mechanism 25 reciprocatingly moves the separating unit 24 in the forward and backward directions (the axial direction) by cooperation of the eccentric cam 51 integrally rotating with the input gear 50 and the biasing member 52. In detail, the eccentric cam 51 is rotated while making the cam face 54 contact with the separating claws 40, and thereby, reciprocatingly moves the separating claws 40 in the forward and backward directions (the axial direction). Hereinafter, on the assumption that a case where the first cam face 54A comes into contact with the bent piece 42A of the supporting frame 41 is an "initial state" (zero degree), it will be concretely described (refer to a top figure in FIG. 7 and FIG. 8A).

In the initial state, the eccentric cam 51 presses backwardly the separating unit 24 against biasing force of the biasing member 52, and the separating unit 24 is positioned at a rearmost side (refer to the top figure in FIG. 7). When the eccentric cam 51 starts rotating from the initial state, the bent piece 42A relatively slides on the cam face 54. In a case where the bent piece 42A relatively slides on the section of the first cam face 54A (refer to a broken line arrow), the separating unit 24 is not moved and remains a state positioning at the rearmost side (refer to FIG. 8A).

In a case where rotation of the eccentric cam 51 is advanced and the bent piece 42A relatively slides from the first cam face 54A to the second cam face 54B, since the eccentric radius of the cam face 54 is gradually shortened, the separating unit 24 is gradually moved forwardly by being biased by the biasing member 52 (refer to a second figure in FIG. 7).

When the bent piece 42A reaches the second cam face 54B, the separating unit 24 becomes a state positioning at the foremost side (refer to a third figure in FIG. 7). In a case where the bent piece 42A relatively slides on the section of the second cam face 54B (refer to a broken line arrow), the separating unit 24 is not moved and remains a state positioning at the foremost side (refer to FIG. 8A).

In a case where rotation of the eccentric cam 51 is further advanced and the bent piece 42A relatively slides from the second cam face 54B to the first cam face 54A, since the eccentric radius of the cam face 54 is gradually lengthened, the separating unit 24 is gradually moved backwardly by being biased by the biasing member 52 (refer to a last figure in FIG. 7). When the bent piece 42A reaches the first cam face 54A again, the separating unit 24 returns the initial state (refer to a top figure in FIG. 7).

Thus, when the eccentric cam 51 is rotated by 360 degrees, the separating unit 24 is reciprocated once in the forward and backward directions. When the eccentric cam 51 repeats rotation, the separating unit 24 (the separating claws 40) repeats reciprocating movement.

The moving amount MA of the separating claws 40 is determined by a difference between the maximum radius and the minimum radius of the eccentric cam 51. In the present embodiment, because the difference between the maximum radius and the minimum radius of the eccentric cam 51 is set to approximately 4 mm, the moving amount MA of the separating claws 40 (refer to FIG. 7) is set to approximately 4 mm. Moreover, in the present embodiment, a width of the separating claw 40 in the forward and backward directions (a width in the axial direction (refer to FIG. 7)) is set to approximately 3 mm. Therefore, a distance between a front end of the separating claw 40 being a state positioning at the foremost side and a rear end of the separating claw 40 being a state positioning at the rearmost side (with respect to the separating claw 40, the moving range MR=the moving amount MA+the width in the forward and backward directions (refer to FIG. 7)) is set to approximately 7 mm. That is, the moving range MR of the separating claw 40 is set larger than twice the width of the separating claw 40 in the forward and backward directions by 1 mm.

As described above, the moving mechanism 25 reciprocates the separating claws 40 in the forward and backward directions, and temporarily stops the separating claws 40 at both ends of the moving range MR of the separating claws 40. Concretely, two sections without varying the radius (the first and second cam faces 54A and 54B) are provided on the cam face 54 of the eccentric cam 51, and the separating claws 40 are stopped at these sections. Incidentally, time for temporarily stopping the separating claws 40 is set to a degree of 11-12% of one cycle of the eccentric cam 51, e.g. approximately one second in the embodiment (refer to FIG. 8).

Figure 9A:
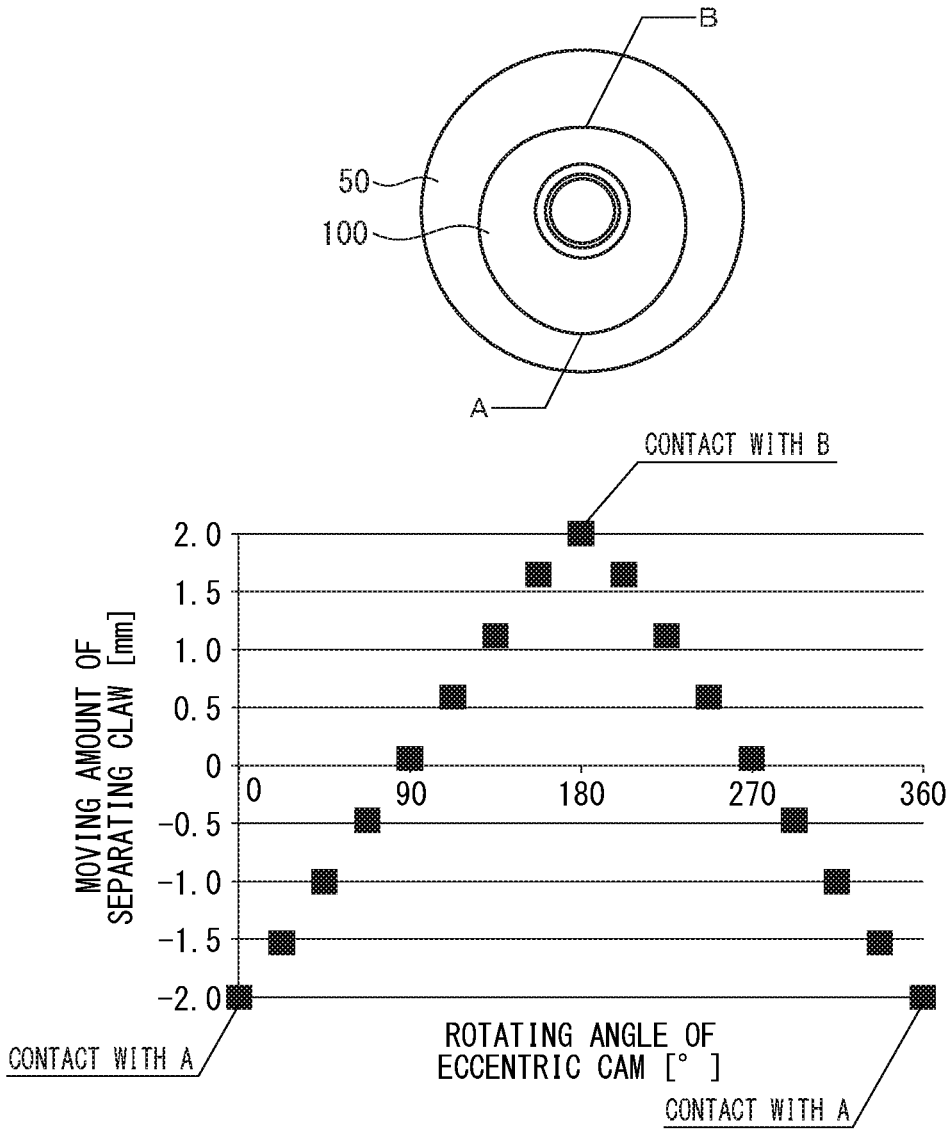
FIG. 9A is a graph plotting relationship of a moving amount of a separating claw and a rotating angle of an eccentric cam in a moving mechanism according to a comparative example.
Figure 9B:
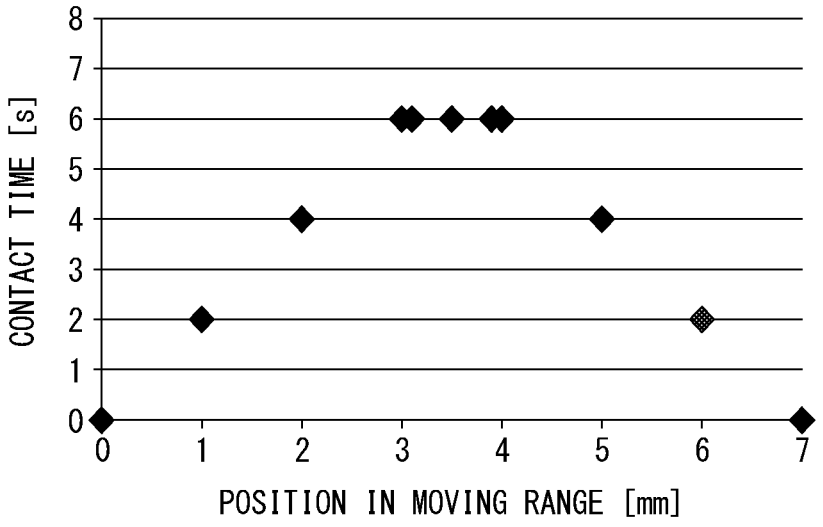
FIG. 9B is a graph plotting contact time of the separating claw within a moving range in the moving mechanism according to the comparative example.

Here, with reference to FIGS. 9A and 9B, a case where a moving mechanism of a comparative example adopts an eccentric cam 100 without any section having same radiuses and the separating claws 40 are not stopped at both ends of the moving range MR will be mentioned. FIG. 9A is a graph plotting relationship of the moving amount MA of the separating claws 40 and a rotating angle of the eccentric cam 100 in the moving mechanism according to the comparative example. FIG. 9B is a graph plotting contact time of the separating claws 40 within the moving range MR in the moving mechanism according to the comparative example.

In the case of the comparative example, as shown in FIG. 9A, the separating claws 40 are moved by the same distance (a constant distance) per a unit angle. That is, the separating claws 40 are reciprocatingly moved in accordance with rotation of the eccentric cam 100 at constant speed without stopping at both ends of the moving range MR (refer to an A point and a B point of the eccentric cam 100). Therefore, as shown in FIG. 9B, contact time of the separating claws 40 with the fixing roller 21 is extremely increased at a center portion (the vicinity of 3-4 mm) of the moving range MR in comparison with both end portions (the vicinity of 0 mm and 7 mm) of the moving range MR. As a result, a portion of the surface of the fixing roller 21 corresponding to the center portion of the moving range MR is convergently scraped.

By contrast, in the fixing device 7 according to the present embodiment, the moving mechanism 25 adopts the eccentric cam 51 with the section having same radiuses and the separating claws 40 are stopped at both ends of the moving range MR. Concretely, as shown in FIG. 8A, when the angle of the eccentric cam 51 becomes the vicinity of zero degree (360 degrees) and the vicinity of 180 degrees, the separating claws 40 are not moved and stays at the same position (a constant position). Moreover, as shown in FIG. 8B, contact time of the separating claws 40 with the fixing roller 21 is increased at both end portions (the vicinity of 0 mm and 7 mm) of the moving range MR and decreased at a center portion (the vicinity of 3-4 mm) of the moving range MR in comparison with the above-mentioned comparative example. That is, stay time of the separating claws 40 is designed to be uniform at each position of the moving range MR.

In accordance with the fixing device 7 according to the above-described present embodiment, since the moving mechanism 25 temporarily stops the separating claws 40 at both ends of the moving range MR, in comparison with a case of not stopping, it is possible to lengthen the contact time of the separating claws 40 and the fixing roller 21 at both ends of the moving range MR and to shorten the contact time at the center portion of the moving range MR. Thereby, it is possible to correct extreme deviation of the contact time (the stay time) of the separating claws 40 between the center portion and both ends of the moving range MR. As a result, it is possible to uniformize a scraped amount of the surface of the fixing roller 21 within the moving range MR and to lengthen lifetime of the fixing roller 21.

Moreover, in the fixing device 7 according to the embodiment, the cam face 54 of the eccentric cam 51 is the continuously curved face including the first cam face 54A and the second cam face 54B. The first cam face 54A within the section of the maximum radius corresponds to temporary stopping at one end of the moving range MR of the separating claws 40. The second cam face 54B within the section of the minimum radius corresponds to temporary stopping at the other end of the moving range MR of the separating claws 40. In accordance with such a configuration, by adjusting (lengthening or shortening) the sections of the first cam face 54A and the second cam face 54B, it is possible to adjust (lengthen or shorten) the time for temporarily stopping the separating claws 40. That is, by changing the eccentric cam 51 with difference profile, it is possible to freely vary the time for temporarily stopping the separating claws 40. In addition, since the moving mechanism 25 is configured by a simple cam mechanism with little trouble, it is possible to secure stable operation over a long period.

Further, in accordance with the fixing device 7 according to the embodiment, by setting the time for temporarily stopping the separating claws 40 by a degree of 11-12% of one cycle of the eccentric cam 51, it is possible to uniformize the stay time of the separating claws 40 at each position of the moving range MR.

Furthermore, in accordance with the fixing device 7 according to the embodiment, since the moving range MR of the separating claw 40 is set larger than twice the width of the separating claw 40 in the forward and backward directions, it is possible to prevent the separating claws 40 from continuously coming into sliding contact with the same portion of the fixing roller 21. Thereby, it is possible to effectively restrain partly wear of the fixing roller 21.

Incidentally, in the fixing device 7 according to the embodiment, although the four separating claws 40 are provided, the disclosure is not restricted by this example, and one or more separating claws 40 may be provided. Moreover, although the moving mechanism 25 reciprocates the separating claws 40 in the forward and backward directions, via the supporting frame 41, the disclosure is not restricted by this example, and it may be configured so that the eccentric cam 51 directly comes into contact with the separating claws 40 to reciprocate the separating claws 40.

Moreover, in the fixing device 7 according to the embodiment, although the cam face 54 of the eccentric cam 51 is formed so that the time for temporarily stopping the separating claws 40 is set to a degree of 11-12% of one cycle of the eccentric cam 51, the disclosure is not restricted by this example. In order to restrain the separating claw 40 from convergently scraping a portion of the surface of the fixing roller 21 corresponding to the center portion of the moving range MR, the cam face 54 may be formed so that the time for temporarily stopping the separating claws 40 is set to a range from 10% to 50% of one cycle of the eccentric cam 51. For example, if the stopping time of the separating claws 40 is set to one quarter cycle (25%) of the eccentric cam 51, the contact time (the stay time) at the center portion of the moving range MR is decreased by 8.3% in comparison with a case of not stopping the separating claws 40. Alternatively, for example, if the stopping time of the separating claws 40 is set to half cycle (50%) of the eccentric cam 51, the contact time at the center portion of the moving range MR is decreased by 16.7% in comparison with a case of not stopping the separating claws 40.

Further, in the fixing device 7 according to the embodiment, although the moving range MR of the separating claw 40 is set to a degree slightly exceeding twice the width of the separating claw 40 in the forward and backward directions, the disclosure is not restricted by this example. The moving range MR of the separating claw 40 may be set from twice to three times the width of the separating claw 40 in the forward and backward directions.

Furthermore, in the fixing device 7 according to the embodiment, although the moving mechanism 25 is configured by the cam mechanism using the eccentric cam 51, the disclosure is not restricted by this example. For example, as another moving mechanism, instead of the cam mechanism (the eccentric cam 51 and others), a solenoid, a rack and pinion mechanism or the like may be applied (not shown). In such a case, it is preferable that a plunger of the solenoid or a rack gear is connected to the separating unit 24 or the separating claws 40 to reciprocate the separating claws 40.

Moreover, in the fixing device 7 according to the embodiment, although the driving motor 32 drives and rotates the fixing roller 21, the disclosure is not restricted by this example and the driving motor 32 may drive and rotate the pressuring roller 22. In addition, in the embodiment, although the pressure adjusting part moves the pressuring roller 22 to vary pressure force in the pressuring area N, the disclosure is not restricted by this and the pressure adjusting part moves the fixing roller 21 to vary pressure force in the pressuring area N.

Incidentally, although, in the present embodiment, a case where the present disclosure is applied to the color printer 1 has been described as one example, the disclosure is not restricted by this, but may be applied to a monochrome printer, a copying machine, a facsimile, a multifunction peripheral or the like.

Incidentally, the above-description of the embodiments illustrates one aspect of the fixing device and the image forming apparatus including this according to the present disclosure, but the technical scope of the disclosure is not limited to the above-described embodiments.

The invention claimed is:

1. A fixing device comprising:

a fixing member heating a toner image on a recording medium while rotating around an axis;

a separating claw separating the recording medium from a surface of the fixing member; and a moving mechanism reciprocating the separating claw in an axial direction and temporarily stopping the separating claw at both ends of a moving range of the separating claw, wherein the moving mechanism includes:

an eccentric cam rotating while making a cam face of the eccentric cam directly or indirectly contact with the separating claw to reciprocate the separating claw in the axial direction; and a biasing member biasing the separating claw toward the cam face, the cam face of the eccentric cam is a continuously curved face including a first cam face and a second cam face, the first cam face is within a section of a maximum radius and corresponds to temporary stopping at one end of the moving range of the separating claw, the second cam face is within a section of a minimum radius and corresponds to temporary stopping at the other end of the moving range of the separating claw, and the cam face of the eccentric cam is formed so that time for temporarily stopping the separating claw is set to a range from 10% to 50% of one cycle of the eccentric cam.

2. The fixing device according to claim 1 wherein, the moving range of the separating claw is set from twice to three times a width of the separating claw in the axial direction.

3. The fixing device according to claim 1 wherein, the fixing member has an end to which a fixing gear is attached, to the fixing gear, a driving motor is connected via a gear train, the eccentric cam is protruded from an end face of an input gear and located so that a center of the eccentric cam is at a position shifted from a gear shaft part of the input gear, the input gear is connected to the driving motor via a power transmitting mechanism.

4. The fixing device according to claim 1, wherein the first cam face and/or the second cam face are/is provided in a range from one quarter cycle to half cycle of the eccentric cam.

5. An image forming apparatus comprising:

the fixing device according to claim 1.

6. An image forming apparatus comprising:

the fixing device according to claim 2.

7. An image forming apparatus comprising:

the fixing device according to claim 3.

8. An image forming apparatus comprising:

the fixing device according to claim 4.

* * * * *